US007331828B2

(12) United States Patent
Allison

(10) Patent No.: US 7,331,828 B2
(45) Date of Patent: Feb. 19, 2008

(54) ELECTRICAL CONNECTOR KEY

(75) Inventor: Jeffrey Allison, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/071,705

(22) Filed: Mar. 2, 2005

(65) Prior Publication Data

US 2006/0199437 A1 Sep. 7, 2006

(51) Int. Cl.
*H01R 13/64* (2006.01)

(52) U.S. Cl. ..... 439/681; 439/607

(58) Field of Classification Search ..... 439/680, 439/681, 607, 677
See application file for complete search history.

(56) References Cited

U.S. PATENT DOCUMENTS

| | | | | |
|---|---|---|---|---|
| 4,365,857 | A | 12/1982 | Watanabe et al. | 339/17 C |
| 6,319,070 | B1 * | 11/2001 | Tan | 439/680 |
| 6,336,827 | B1 | 1/2002 | Akama et al. | 439/610 |
| 6,350,156 | B1 * | 2/2002 | Hasircoglu et al. | 439/676 |
| 6,431,919 | B1 * | 8/2002 | Wang et al. | 439/680 |
| 6,869,319 | B2 * | 3/2005 | Yamada et al. | 439/681 |
| 6,966,798 | B1 * | 11/2005 | Wu | 439/677 |

* cited by examiner

*Primary Examiner*—Hien Vu
*Assistant Examiner*—X. Chung-Trans
(74) *Attorney, Agent, or Firm*—Harrington & Smith, PC

(57) ABSTRACT

An electrical connector including a housing; electrical contacts connected to the housing; a shield connected to the housing; and a mating connector key connected to the housing. The key includes a front section and a rear section. A portion of the shield is located between the front and rear sections of the key to retain the key with the housing.

9 Claims, 3 Drawing Sheets

ELECTRICAL CONNECTOR KEY

BACKGROUND OF THE INVENTION

1. Field of the Invention

The present invention relates to an electrical connector and, more particularly, to a mating connector key for an electrical connector.

2. Brief Description of Prior Developments

U.S. Pat. No. 4,365,857 discloses an electrical connector with polar key elements which can be selectively connected to an electrical connector housing. Fujitsu Component Limited has an Infiniband electrical connector with plastic general U shaped polar keys which can be slid onto a metal shield at a front of the electrical connector. A problem with this type of key is that the key can become disconnected from the electrical connector. Another problem with this type of key is that, because it is plastic, it can be prone to breakage. There is a desire to provide a keying system which is less prone to damage and has less likelihood of becoming unintentionally disconnected from the electrical connector.

SUMMARY OF THE INVENTION

In accordance with one aspect of the present invention, an electrical connector is provided including a housing; electrical contacts connected to the housing; a shield connected to the housing; and a mating connector key connected to the housing. The key includes a front section and a rear section. A portion of the shield is located between the front and rear sections of the key to retain the key with the housing.

In accordance with another aspect of the present invention, an electrical connector mating connector key for an electrical connector is provided comprising a rear section which is sized and shaped to be located behind a portion of a shield of the electrical connector; and a front section which is sized and shaped to be located in front of a front portion of the shield. The front section of the key forms a keying projection of the key. The front and rear sections are adapted to be located at opposite ends of the shield to retain the key with the shield.

In accordance with one method of the present invention, a method of assembling an electrical connector is provided comprising locating a mating electrical connector key on a housing; connecting a shield to the housing, wherein the shield locks a portion of the key on the housing; and deforming a front portion of the key at a front end of the shield to form an outwardly projecting keying projection at a front of the electrical connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
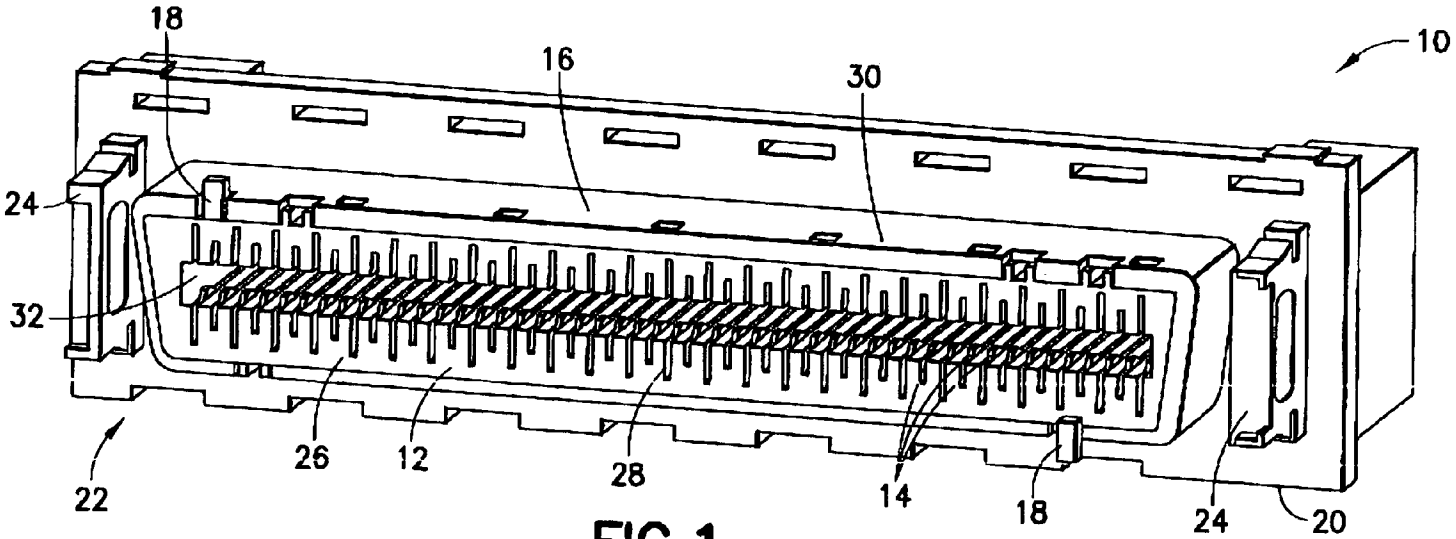
FIG. 1 is a perspective view of an electrical connector incorporating features of the present invention.

Referring to FIG. 1, there is shown a perspective view of an electrical connector 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

Figure 2:
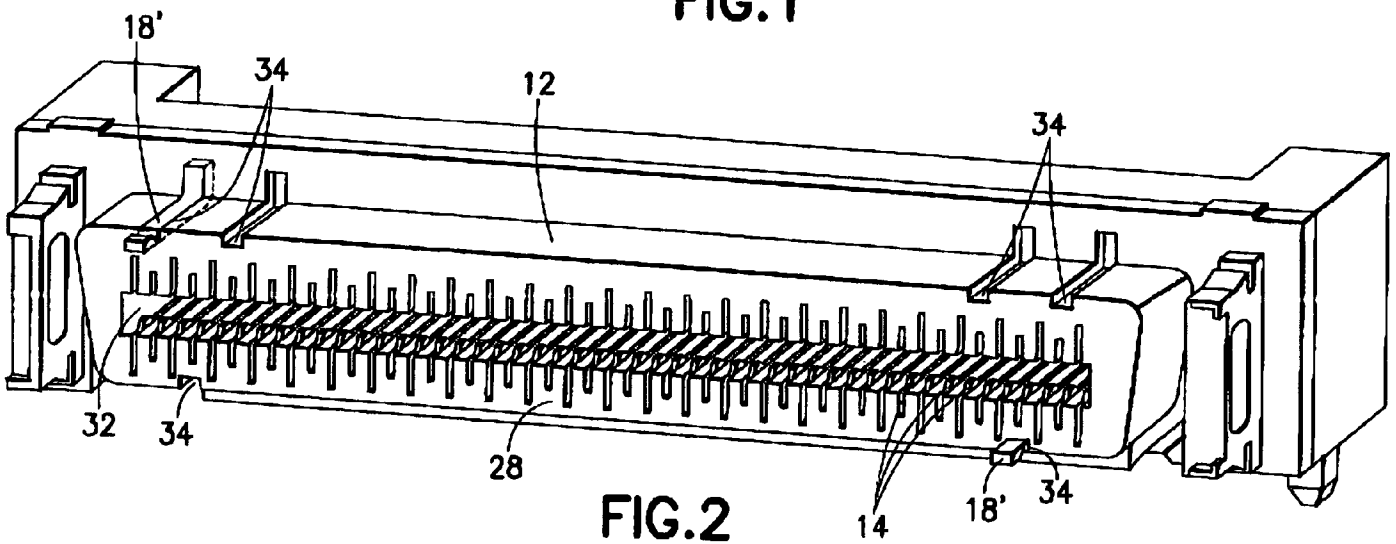
FIG. 2 is a perspective view of a housing, contact and key subassembly used to form the electrical connector shown in FIG. 1.

The electrical connector 10 generally comprises a housing 12, electrical contacts 14, a shield 16 and at least one mating connector key 18. In the embodiment shown, the electrical connector comprises an Infiniband electrical connector. However, in alternate embodiments, features of the present invention could be used in any suitable type of electrical connector. Referring also to FIG. 2, the housing 12 is preferably comprised of a dielectric material, such as molded plastic or polymer material. In this embodiment the connector 10 has a bottom side 20 adapted to be connected to another electronic component (not shown), such as a printed circuit board, and a front side 22 which is adapted to be connected to a mating electrical connector (not shown). In an alternate embodiment, the electrical connector might not be a right angle connector.

The front side 22 of the connector has side latches 24 for the mating electrical connector and a projection 26 between the latches. In this embodiment, the projection 26 has a general trapezoid shape, but any suitable shape can be provided. The general trapezoid shape provides a polarization feature with the mating electrical connector to insure that the mating electrical connector is attached to the electrical connector 10 in only one orientation.

The projection 26 is formed by a forward projecting portion 28 of the housing 12 and a forward projecting portion 30 of the shield 16. The portion 28 of the housing 12 has a receiving slot 32 extending inward from its front face. The slot 32 is adapted to receive a portion of the mating electrical connector (not shown). Resiliently deflectable contact surfaces of the electrical contacts 14 extend into the slot 32 from top and bottom sides of the slot. As best seen in FIG. 2, the exterior top and bottom surfaces of the portion 28 of the housing 12 also comprises key slots 34. The key slots 34 each have a general L shape. In the embodiment shown, the housing 12 has six of the key slots 34. However, more or less key slots could be provided and the key slots could be located at any suitable location(s).

In the embodiment shown, the connector 10 has two of the keys 18. However, in alternate embodiments, the connector could comprise more or less than two of the keys. In addition, the locations of the keys 18 in the key slots 34 is preferably configured to key or configure the electrical connector 10 for mating connection with only a predetermined correspondingly configured mating electrical connector. FIG. 2 shows the connector 10 with two of the keys 18 located on the housing, but before the shield 16 is attached, and before the keys are deformed into their final shape.

Figure 3:
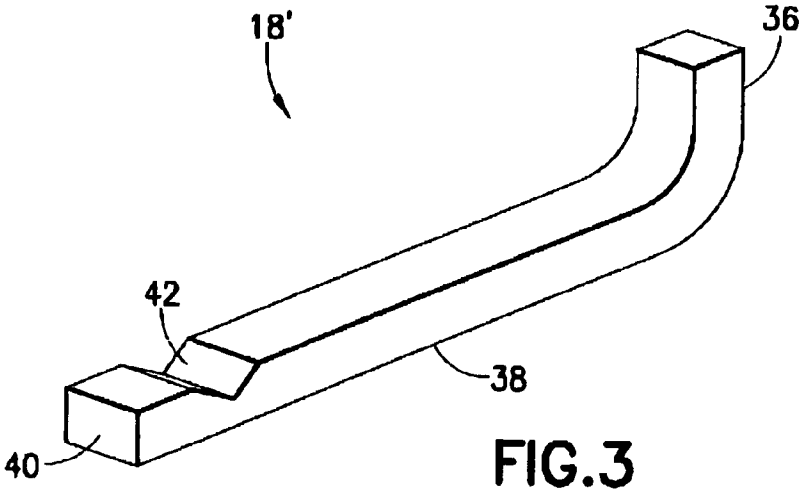
FIG. 3 is a perspective view of one of the keys shown in FIG. 2.
Figure 5:
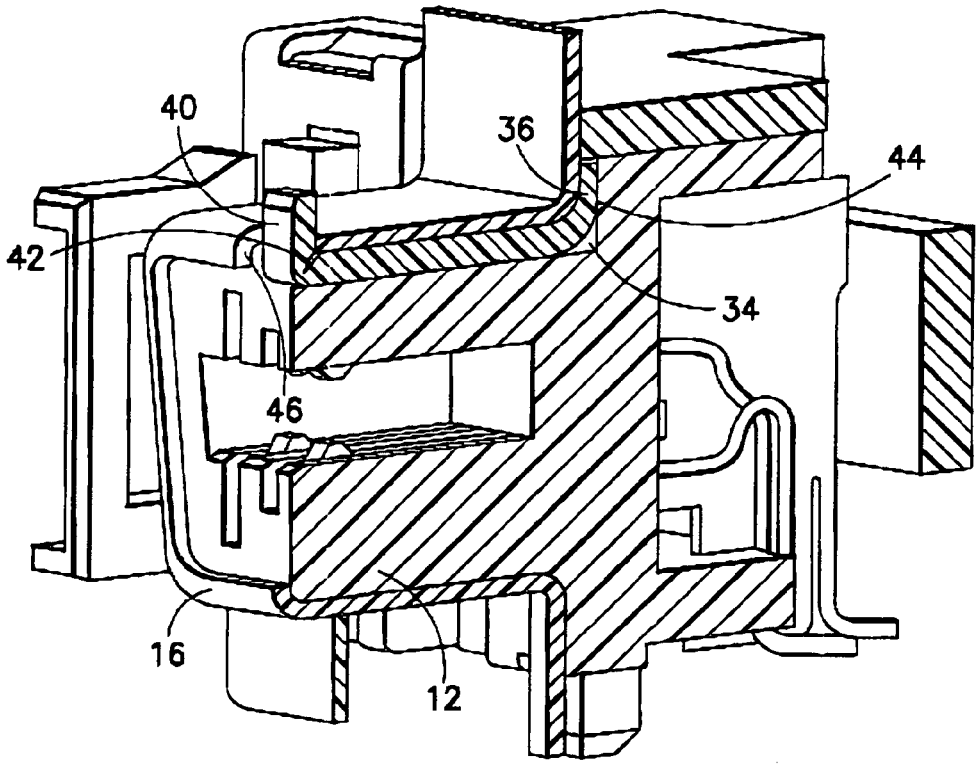
FIG. 5 is a cross sectional view of the electrical connector shown in FIG. 1.

Referring also to FIG. 3, a perspective view of one of the keys 18' before it is deformed into its final shape is shown. The keys 18' are preferably comprised of metal such that the keys 18' can be permanently deformed into the shape of the keys 18 after the shield is connected to the housing. Each key 18' comprises a general L shape with a rear section 36, a middle section 38, and a front section 40. The front section 40 comprises a concave recess 42 at its junction with the middle section 38. In this embodiment the concave recess 42 has a general V shape. However, in alternate embodiments other shape(s) could be provided. The recess 42 provides a weakened section adapted to be bent. More specifically, as seen in FIGS. 1 and 5, the front section 40 can be bent at the recess 42 to transform the general L shape of the key 18' into a general U shape of the key 18. However, this transformation preferably occurs after the keys 18' are located on the housing 12 and after the shield 16 is mounted to the housing 12.

Figure 4:
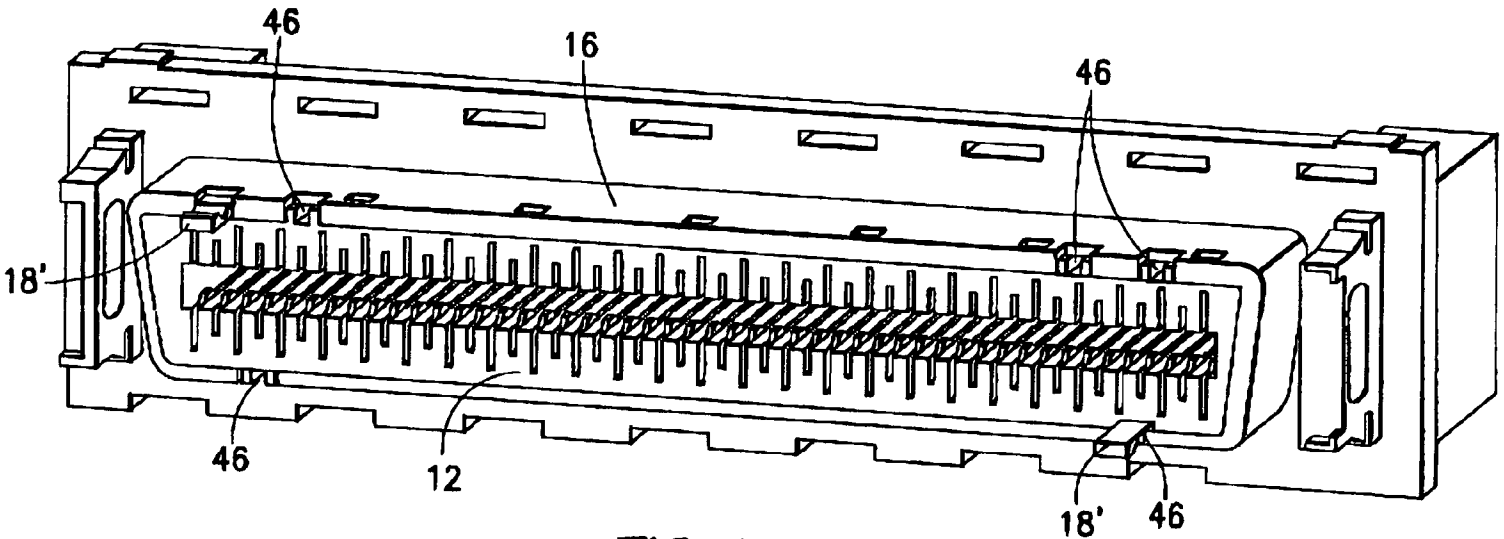
FIG. 4 is a perspective view of the subassembly shown in FIG. 2 with the shield attached to the housing, but before final deformation of the keys.

The method of assembling the connector 10 includes locating the keys 18' in predetermined ones of the key slots 34 as shown in FIG. 2. As seen in FIG. 5, the rear section 36 of the key is located in the rear section 44 of the slot 34. The rear section 36 is sized and shaped to be located behind a portion of the shield. The middle section 38 of the key is mounted in the rest of the key slot 34, and the front section 40 extends forward out of the front of the key slot 34 as seen in FIG. 2. The shield 16 is then is then mounted onto the housing 12 as seen in FIG. 4. Because the front section 40 has not been deformed yet, the shield 16 is able to slide over the front section 40 and capture the rear section 36 and middle section 38 in the key slot 34. The shield 16 surrounds the portion 28 of the housing 12 and has small slots 46 at its front end aligned with the key slots 34. The small slots 46 provide open areas for the front sections 40 to be deformed outward as seen in FIG. 5. The front section is sized and shaped to be located in front of a front portion of the shield. The L shaped rear end of the key is sandwiched between the shield and the housing. However, in alternate embodiments, any suitable type of mounting could be provided.

Referring specifically to FIGS. 5 and 1, after the shield 16 is attached to the housing 12, the keys 18' are then deformed to form the keys 18. More specifically, the front sections 40 are deformed outward with the keys bending at the recesses 42. This captures a portion of the shield 16 between the front and rear sections 40, 36 of the key 18. The front and rear sections are adapted to be located at opposite ends of the shield to retain the key with the shield. This locks the keys 18 to the shield 16 and, thus, locks the keys 18 to the housing 12. The outwardly deformed front sections 40 of the keys 18 form keying projections which allow connection of only a matingly configured mating electrical connector.

Figure 6:
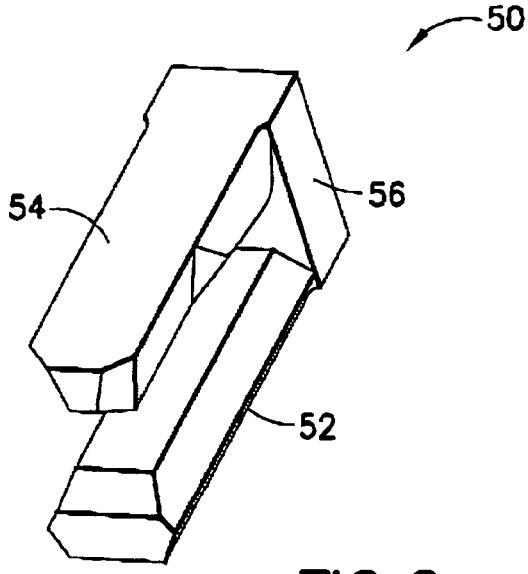
FIG.6 PRIOR ART
FIG. 6 is a perspective view of a key used in a conventional electrical connector.

Referring also to FIG. 6, a perspective view of a key used in a conventional electrical connector is shown. The key 50 is comprised of plastic. A first section 52 is slid into the keying slot of the housing, a second section 54 is located against the exterior surface of the shield, and the third section extends across a front section of the shield. The key 50 is connected to the electrical connector after the shield is connected to the housing. Unlike the present invention, the key 50 can be inadvertently removed from the electrical connector. With the present invention, on the other hand, the key(s) 18 is connected to the housing before the shield is connected to the housing, and the key(s) 18 cannot be inadvertently removed from the connector after the shield is attached to the housing. With the present invention, once the key(s) are connected to the shield, they are not easily removed and, because they can be made of metal, are not easily broken off.

With the present invention, the key(s) 18 can be selectively located in any number of the key slots 34 for selectively configuring the key layout of the electrical connector, and thereby limiting the type of mating electrical connector which can be subsequently connected to the electrical connector. In one type of alternate embodiment, rather than sandwiching the rear section of the key between the shield and the housing to capture the key, any suitable type of permanent mounting system could be provided. However, with the system described above, key mounting is relatively easy because the shield merely needs to be mounted to the housing to thereby permanently attach the key(s) to the housing.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing;

electrical contacts connected to the housing;

a shield connected to the housing; and a mating connector key connected to the housing, wherein the key comprises a front section and a rear section, wherein the front section of the key is at a front end of the shield, wherein a portion of the shield is located between the front and rear sections of the key to retain the key with the housing, wherein the rear section of the key is captured between a rearward facing surface of the shield and an opposite forward facing surface of the housing, wherein the rear section comprises a general L shape, wherein the front section comprises a general L shape, wherein the front section comprises an outwardly deformed projection, wherein the key comprises a concave recess at a bend of the key which forms the outwardly deformed projection.

2. An electrical connector as in claim 1 further comprising a least one second key.

3. An electrical connector as in claim 1 wherein the key is comprised of metal.

4. An electrical connector mating connector key for an electrical connector, the key comprising:

a rear section which is sized and shaped to be located behind a rear portion of a shield of the electrical connector to capture the rear section directly between a rearward facing surface of the rear portion of the shield and a forward facing surface of a housing of the electrical connector; and a front section which is sized and shaped to be located in front of a front portion of the shield, wherein the front section of the key forms a keying projection of the key, and wherein the front and rear sections are adapted to be located at opposite ends of the shield to retain the key with the shield, wherein the rear section comprises a general L shape, wherein the front section comprises a concave recess forming a weakened section adapted to be bent, wherein the front section is adapted to be deformed into a general L shape.

5. An electrical connector mating connector key as in claim 4 wherein the key is comprised of metal.

6. An electrical connector comprising:

a housing;

electrical contacts connected to the housing;

a shield connected to the housing; and an electrical connector mating connector key as in claim 4, wherein the front section is deformed in an outward direction at a front end of the shield to form the keying projection.

7. A method of assembling an electrical connector comprising:

locating a mating electrical connector key on a housing;

connecting a shield to the housing, wherein a rear end of the shield locks a rear portion of the key on the housing; and deforming a front portion of the key at a front end of the shield after the key is connected to the shield to form an outwardly projecting keying projection at a front of the electrical connector, wherein the outwardly projecting keying projection locks the front portion of the key on the housing, wherein the key comprises a rear end with a general L shape which is sandwiched between the shield and the housing, wherein the front portion of the key is deformed into a general L shape, wherein deforming the front portion of the key occurs after the shield is connected to the housing.

8. A method as in claim 7 wherein the key is comprised of metal and comprises a recess forming a weakened area for deforming the front portion to form the outwardly projecting keying projection.

9. A method as in claim 7 wherein locating the key on the housing comprises locating a portion of the key in a slot on the housing and the key projecting straight out of a front end of the slot such that the shield can be slid over the slot without interference from the key during the connecting of the shield to the housing.

* * * * *